US009399843B2

(12) United States Patent
Busley et al.

(10) Patent No.: US 9,399,843 B2
(45) **Date of Patent: *Jul. 26, 2016**

(54) AUTOMOTIVE ROAD MILLING MACHINE

(71) Applicant: Wirtgen GmbH, Windhagen (DE)

(72) Inventors: Peter Busley, Linz/Rhein (DE); Thomas Lehnert, Oberraden (DE); Herbert Ley, St. Katharinen (DE); Cyrus Barimani, Königswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/634,346

(22) Filed: Feb. 27, 2015

(65) Prior Publication Data

US 2015/0204032 A1 Jul. 23, 2015

Related U.S. Application Data

(63) Continuation of application No. 12/969,698, filed on Dec. 16, 2010, now Pat. No. 8,985,702.

(30) Foreign Application Priority Data

Dec. 18, 2009 (DE) ..... 10 2009 059 064

(51) Int. Cl.
*E01C 23/088* (2006.01)
*E01C 23/12* (2006.01)
*B28D 1/18* (2006.01)

(52) U.S. Cl.
CPC ..... *E01C 23/088* (2013.01); *E01C 23/127* (2013.01); *B28D 1/188* (2013.01)

(58) Field of Classification Search
CPC ..... E01C 23/127; B28D 1/188
USPC ..... 299/39.1, 39.2, 39.4; 404/90, 93, 94
See application file for complete search history.

(56) References Cited

U.S. PATENT DOCUMENTS 4,720,207 A 1/1988 Salani
5,505,598 A 4/1996 Murray (Continued)

FOREIGN PATENT DOCUMENTS

DE 3510596 A1 9/1986
EP 1840268 A1 10/2007

(Continued)

OTHER PUBLICATIONS

Exhibit A: Brochure entitled Roadtec RX-400 Milling Machine, Roadtec, Inc., 7 pages. (undated but admitted to be prior art).

(Continued)

*Primary Examiner* — David Bagnell
*Assistant Examiner* — Michael Goodwin
(74) *Attorney, Agent, or Firm* — Lucian Wayne Beavers; Patterson Intellectual Property Law PC

(57) ABSTRACT

In an automotive road milling machine (1) for milling ground surfaces (3), with a machine frame (2), a milling drum (4) with a quick-change system arranged at the machine frame (2) in a drum housing (11), a driving device (6) for driving the milling drum (4), a reduction gear (8) arranged between the driving device (6) and the milling drum (4), where the milling drum (4) is arranged between drum housing walls (12,13) of the drum housing (11) running orthogonally to the axis of rotation of the milling drum (4), where the quick-change system is provided with a basic drum body (14) and at least one milling tube element (10) capable of being pushed onto the basic drum body (14), where the drum housing wall (13) opposite the drive-side drum housing wall (12) is easily removable for the quick exchange of alternatively usable milling tube elements (10), it is provided for the following features to be achieved: the housing (9) of the reduction gear (8) is attached to the machine frame (2) in a torsionally rigid fashion, inside the machine frame (2), between the driving device (6) and the drum housing wall (12) at the drum housing (11).

28 Claims, 3 Drawing Sheets

(56) References Cited

U.S. PATENT DOCUMENTS

Figure 1:
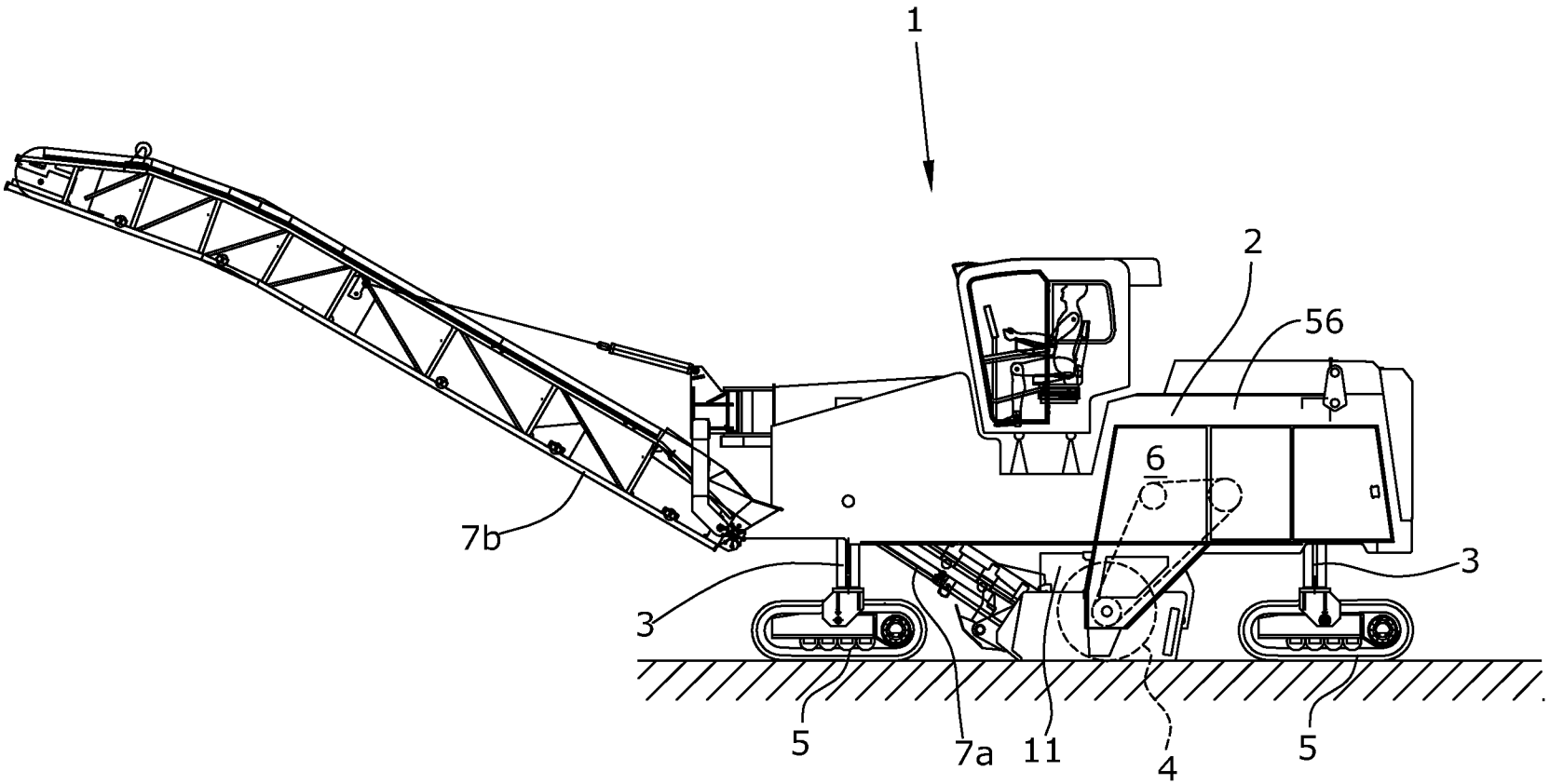

| | | | |
|---|---|---|---|
| 5,722,789 | A | 3/1998 | Murray et al. |
| 6,213,560 | B1 | 4/2001 | Lindblom |
| 6,877,818 | B1 | 4/2005 | Gaertner et al. |
| 7,144,192 | B2 | 12/2006 | Holl et al. |
| 7,810,888 | B2 | 10/2010 | Clark et al. |
| 8,474,919 | B2 | 7/2013 | Cipriani et al. |
| 2005/0158120 | A1 | 7/2005 | Holl et al. |
| 2007/0228806 | A1 | 10/2007 | Holl et al. |
| 2009/0067927 | A1 | 3/2009 | Stiffler et al. |

FOREIGN PATENT DOCUMENTS

| | | | |
|---|---|---|---|
| JP | 8003919 | A | 1/1996 |
| WO | 0104422 | A1 | 1/2001 |
| WO | 2004005623 | A1 | 1/2004 |
| WO | 2010003436 | A1 | 1/2010 |

OTHER PUBLICATIONS

Exhibit B: Collection of photographs of what is believed to be the internal components of the Roadtec variable cutter system, 8 pages. (undated but admitted to be prior art).

AUTOMOTIVE ROAD MILLING MACHINE

The invention relates to an automotive road milling machine having a quick-change milling drum system.

Owing to different job site situations and milling operations, it may be necessary to adapt the milling tool of a road milling machine to the specific tasks at hand. A milling drum with a specific tool spacing of the milling tools or a different tooling equipment is required if, for example, a specific surface roughness is to be achieved. In another case of use, specific carriageway widths only are to be removed so that a milling drum with a specific working width is required.

A special milling machine must normally be used in such situations, or the machine must be equipped with a milling drum adapted to the task at hand. Exchanging complete milling drums involves a great deal of effort and requires special aids for mounting or removing the milling drum.

The adaptation of the milling tool to different requirements is known in the prior art.

A road milling machine is known from WO 01/04422 (U.S. Pat. No. 6,877,818) with a machine frame in which a milling drum is mounted to rotate, said milling drum being provided with a basic drum body driven by a milling drum driving device via a supporting gear, and alternatively usable, coaxial milling tube elements capable of being pushed onto the basic drum body on one side and attached in an interchangeable manner, which carry cutting tools on the outer surface.

According to this prior art, the reduction gear is provided on the drive side if milling tube elements of equal length only are to be interchangeable. It is of disadvantage in this design that the reduction gear is arranged in the basic drum body, which results in the heat generated in the gear not being able to be removed, and is additionally exposed to the heat generated at the milling tube elements. If milling tube elements of different length are to be usable, it is provided in accordance with this prior art according to an alternative design that the reduction gear is arranged on the side opposite the drive side, which causes the problem of heat accumulation to become even greater, as a drive shaft from the drive side to the reduction gear is additionally required, said drive shaft rotating at high speed, which causes additional heat to be generated and does not improve the conditions for heat removal in comparison with the embodiment first mentioned.

Another prior art device is known from EP-A-1 520 076 (U.S. Pat. No. 7,144,192). The automotive road milling machine for milling ground surfaces described therein is provided with the following elements:

a machine frame, a milling drum with a quick-change system arranged at the machine frame in a drum housing, a driving device for driving the milling drum, a reduction gear arranged between the driving device and the milling drum in a kinematic fashion, where the milling drum is arranged between drum housing walls of the drum housing running orthogonally to the axis of rotation of the milling drum, where the quick-change system is provided with a basic drum body and at least one milling tube element capable of being pushed onto the basic drum body, where the drum housing wall opposite the drum housing wall on the drive side is easily removable for the quick exchange of alternatively usable milling tube elements.

According to this prior art, the reduction gear is arranged on the drive side between the basic drum body and the drive-side side plate of the drum housing, and is connected to the same via a front end only. It is of disadvantage in this design that the support of the reaction forces needs to be effected via a small lever arm. The connection at the front end is required for the reason that the gear is designed as a planetary gear with rotating housing. In addition, the gear is to have the smallest possible diameter, with the length of the gear increasing simultaneously as a result. It is of disadvantage in this design that the mechanical connection between the basic drum body and the reduction gear is shifted to the area where the highest bending moments occur, with the lever arm for transmission of the bending moments being small owing to the small gear diameter, which causes high forces to be generated at the connection elements. Additional disadvantages are that the maximum possible milling depth is limited and that the reduction gear is exposed to high thermal loads because the reduction gear is enclosed either by an additional protective tube or by a milling tube element. The thermal load and the reduced bending stiffness lead to higher wear and tear of the elements.

It is the object of the invention to create an automotive road milling machine in which improved heat removal and reduced wear and tear and increased stiffness can be provided in a quick-change system for milling tubes.

It is provided according to the present invention that the housing of the reduction gear is attached to the machine frame in a torsionally rigid fashion, inside the machine frame, between the driving device and the drive-side drum housing wall.

The invention leads to major improvements in a quick-change system for milling tubes.

Arrangement of the reduction gear on the drive-side side of the drum housing wall enables improved heat removal and thus reduced susceptibility of the reduction gear to wear and tear. In addition, the housing of the reduction gear is not damaged by the milled material so that no protective casing is required for the reduction gear which would also impede heat removal even further. As the housing of the reduction gear can be attached to the machine frame in a stiff and torsionally rigid fashion, the basic drum body is better supported, enabling a higher stiffness of the change system for milling tubes to be achieved.

The increased stiffness is achieved in that the gear is static and can be attached to the machine frame several times along its length so that the reduction gear can, owing to its stiff attachment, better absorb any forces originating from the milling drum.

The direct permanent attachment of the housing of the reduction gear to the machine frame enables active cooling of the housing, for example, via oil cooling so that the reduction gear is capable of taking higher loads and is more effective, and the dimensions of the reduction gear, in particular its diameter, can be reduced. Active cooling additionally enables wear and tear of the reduction gear to be minimized. A smaller diameter of the reduction gear enables a higher milling depth.

It is preferably provided that the housing of the reduction gear is attached to the machine frame in a torsionally rigid fashion outside the drum housing. The arrangement outside the drum housing offers the advantage of better accessibility of the reduction gear for maintenance procedures. The reduction gear is not exposed to the overheated atmosphere in the drum housing or inside the basic drum body, and is thus not exposed to additional thermal load. In addition, no protective devices are required to protect the reduction gear mechanically against the sharp-edged milled material.

In a preferred embodiment, the reduction gear is provided, on the side facing the drum housing wall, with an output element in which the free end of the basic drum body is mounted and which drives the basic drum body. The output element may support the drive-side free end of the basic drum body in a stiff fashion so that the free end need not be mounted in the drive-side drum housing wall.

The basic drum body may be passed through the drive-side drum housing wall by means of a labyrinth seal, and the free drive-side end of the basic drum body may be connected to the output element in a torsionally rigid fashion. The labyrinth seal prevents dust and heat being able to escape from the drum housing, without passing of the basic drum body through the drum housing wall entailing any frictional losses.

In one embodiment, the basic drum body may be mounted on the one hand, at the end facing the reduction gear, in the reduction gear in a fixed-type bearing, and on the other hand, in a detachable fashion, in the removable drum housing wall of the drum housing in a floating-type bearing. The fixed-type bearing is thus provided on the mechanically stiffer side so that the overall stiffness of the quick-change system for milling tubes can be improved and a statically determined mounting is realized that is able to compensate thermally induced and production-related differences in length.

Between the milling tube element and the drum housing wall, conveying blades (kicker plates) may be attachable to the basic drum body in a preferably regular fashion on the circumference. The conveying blades cause the milled material to be ejected through the discharge opening in the drum housing if the width of the milling tube element is smaller than the width of the drum housing.

Preferably at least the lower edge of the drive-side drum housing wall projects slightly further downwards to the ground surface than the housing of the reduction gear. An effective protection of the reduction gear is thus provided as the lower edges limit the maximum milling depth so that the reduction gear cannot be damaged.

The interchangeable milling tube elements are preferably of integral design.

The drum housing is provided with the discharge opening for the milled material in a wall running parallel to the axis of rotation of the milling drum.

In a preferred embodiment, the diameter ratio between the reduction gear and the cutting radius of the milling tools of the milling tube element is in the range smaller than 0.45, preferably smaller than 0.4, for example, in the range between 0.35 and 0.45, preferably in the range between 0.38 and 0.42. If the basic drum body and the reduction gear can be manufactured with a small diameter in proportion to the milling tube elements, the maximum possible milling depth increases, which enables the range of applications of the road milling machine to be broadened considerably and the use of special machinery to be dispensed with.

Underneath the housing of the reduction gear, wear elements running parallel to the ground can be arranged preferably orthogonally and/or parallel to the axis of rotation of the milling drum, said wear elements resting at the machine frame or at the gear. These wear elements, for example, carbide metal strips, enable the reduction gear to be additionally protected against contact with the ground surface or with objects on the ground surface. The wear elements are preferably arranged in front of the reduction gear when seen in the direction of travel and are attached slightly lower than the lower edge of the reduction gear.

With milling tube elements having a milling width of more than half of the maximum milling width, a support ring may additionally be arranged on the basic drum body which the milling tube element is capable of being pushed onto. Such support rings are known from EP-A-1 840 268 (U.S. 2007/0228806), the disclosure of which is included herein by way of reference.

The driving device with a belt drive may project outward relative to the machine frame, with the housing of the reduction gear being attached, outside the drum housing, between a belt pulley of the belt drive and the drive-side drum housing wall of the drum housing. The belt pulley and the entire belt drive may project outward in relation to the outer wall of the road milling machine.

For the quick exchange of alternatively usable milling tube elements, the drum housing wall opposite the drive-side drum housing wall is arranged on the zero-clearance side of the machine, on which the milling drum, with a front end, rests more or less flush at the longitudinal side of the machine frame to enable milling close to the edge.

The reduction gear may be provided with a planetary gear or may consist of such planetary gear.

In the following, embodiments of the invention are explained in more detail with reference to the drawings.

The following is shown:

FIG. 1 an automotive road milling machine, and

Figure 2:
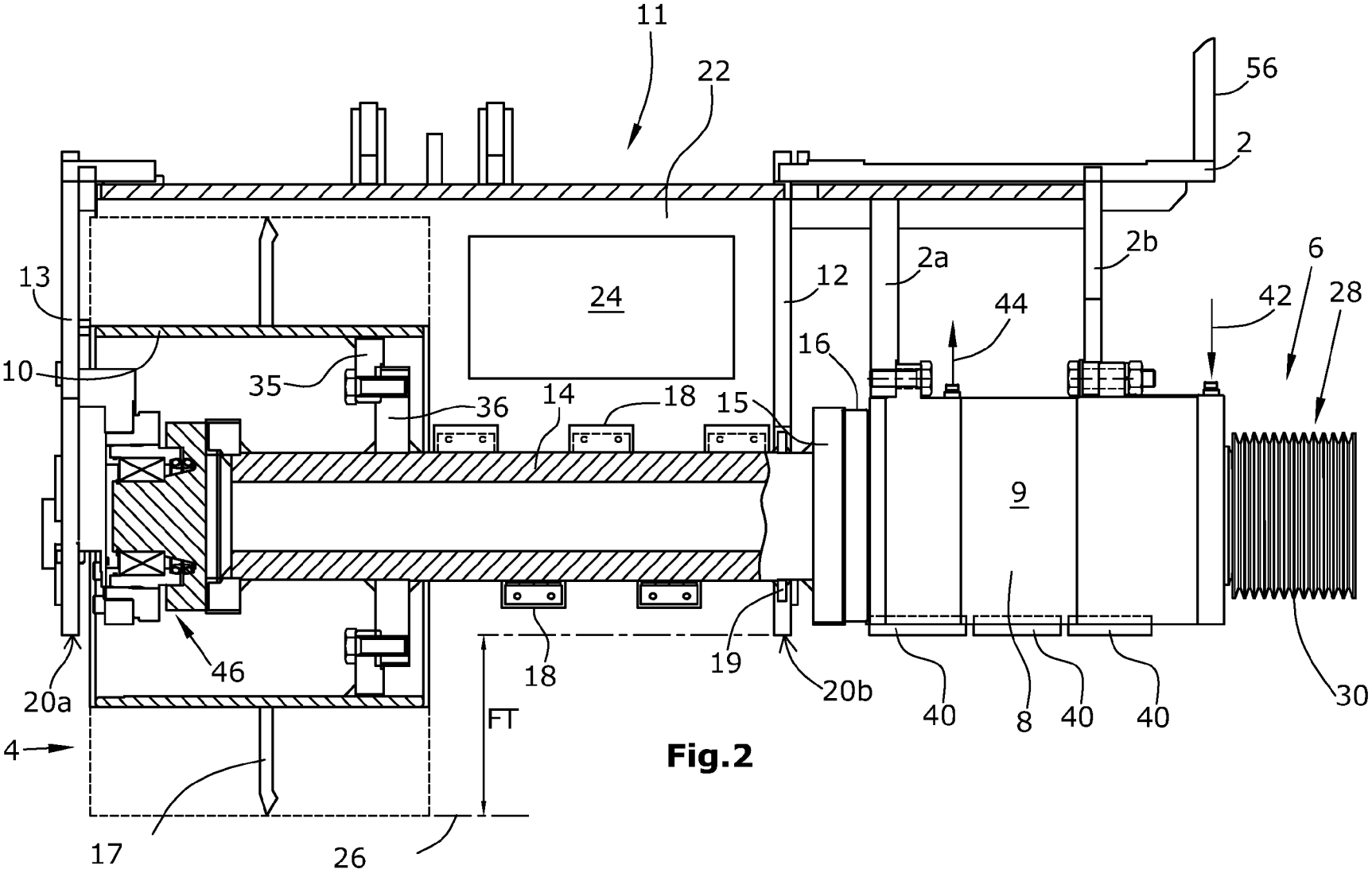

FIG. 2 an embodiment of the quick-change system for milling tubes according to the invention.

Figure 3:
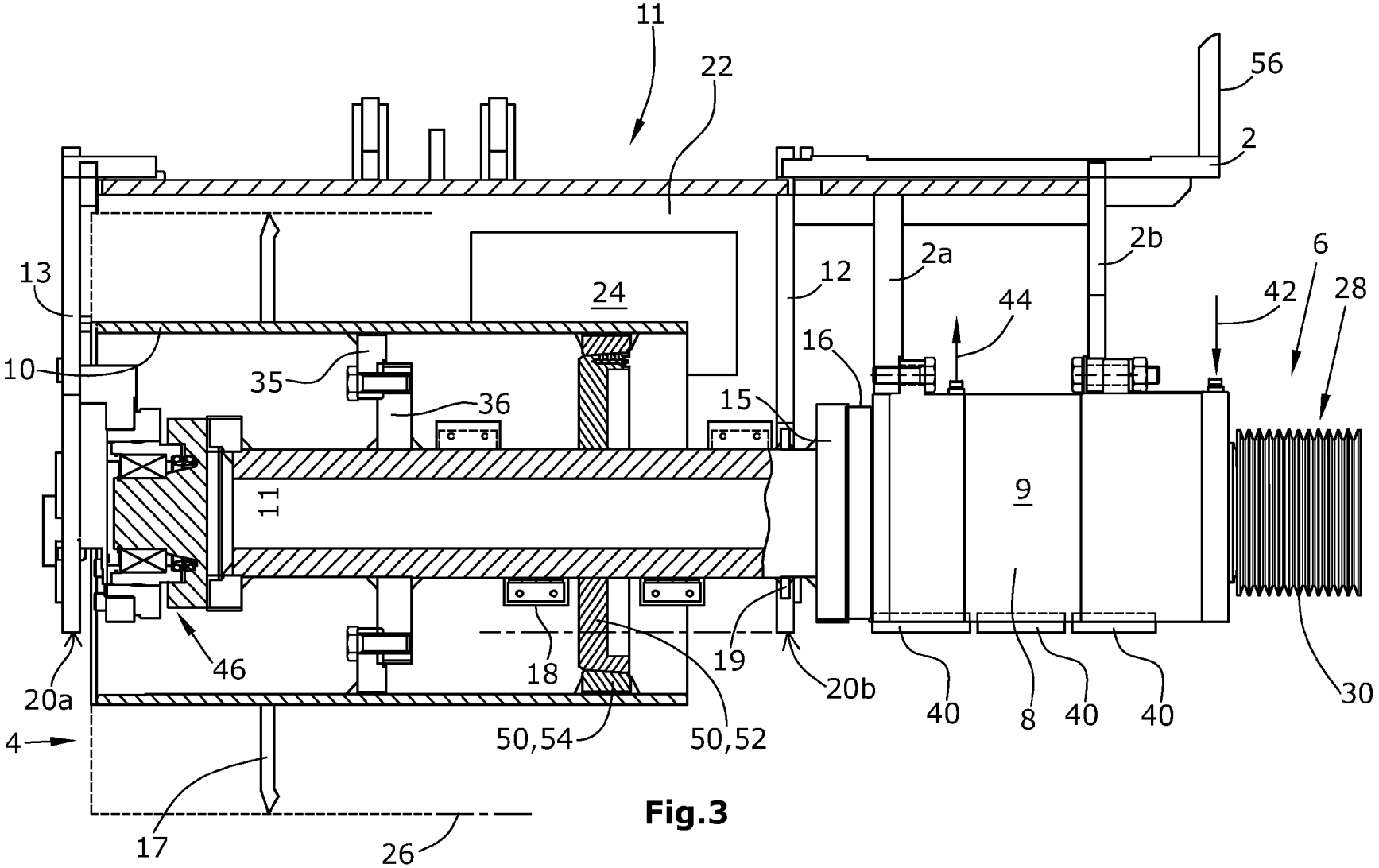

FIG. 3 another embodiment of the quick-change system for milling tubes according to the invention.

FIG. 1 depicts a road milling machine 1 in which the quick-change system for milling tubes described in the following can be used. Road milling machines commonly comprise a machine frame 2, with a combustion engine and operator's platform being mounted on said machine frame. The automotive road milling machine is provided with height-adjustable lifting columns 3 attached to the machine frame 2, where support wheels (not depicted in the figures) or crawler tracks 5 are mounted to said lifting columns 3.

The milling drum 4 is located underneath the machine frame 2 in a drum housing 11, which is limited at the sides by the drum housing walls 12,13. The material removed by the milling drum 4 is discharged, in a basically known manner, through a discharge opening 24 onto a first loading conveyor 7*a* and is transported further onto a second, height-adjustable and slewable loading conveyor 7*b*.

The milling drum 4 is arranged to rotate between drum housing walls 12,13 of the drum housing 11, said drum housing walls 12,13 running orthogonally to the axis of the milling drum 4, and is driven via a driving device 6 and a reduction gear 8.

The reduction gear 8 is attached to the drum housing 11 at an upper terminating wall, with the drum housing 11 being in turn attached to the machine frame 2.

The milling drum 4 is provided with a basic drum body 14 coupled to the reduction gear 8, and at least one milling tube element 10 of integral design which is attached coaxially to the basic drum body 14 in an interchangeable fashion. The basic drum body 14 is arranged axially next to the reduction gear 8. The basic drum body 14 transmits the torque of the reduction gear 8 to the particular milling tube element 10 used.

Alternatively usable milling tube elements 10 of different milling width and different tooling are available for different types of road operations and can be exchanged quickly.

With milling tube elements 10 which have a milling width of more than half of the maximum milling width, a support ring assembly in accordance with EP 1 840 268 (U.S. 2007/0228806) may be arranged on the basic drum body 14 for radial support of the interchangeable milling tube element 10, where the milling tube element 10 is capable of being pushed onto said support ring and where the milling tube element 10 can glide on said support ring in the fashion of a floating-type bearing. The support ring assembly in accordance with EP 1 840 268 (U.S. 2007/0228806) is shown in FIG. 3.

In FIG. 3 a milling tube element 10 having a milling width of more than half of the maximum milling width is shown. A support ring assembly 50 in accordance with EP 1 840 268 (U.S. 2007/0228806) is arranged on the basic drum body 14 for radial support of the interchangeable milling tube element 10. The support ring assembly 50 includes a support ring mount 52 attached to the basic drum body 14 and a support ring 54 attached to the milling tube element 10. The milling tube element 10 is capable of being pushed onto said support ring mount 52, and the milling tube element 10 can glide on said support ring mount 52 in the fashion of a floating-type bearing.

The support ring 54 may be fixed to the milling tube element 10 by welding. The dimensions of the support ring 54 must be such that it can pass over ring 36.

The support ring mount 52 should be detachably mounted on the basic drum body 14 so that the support ring mount 52 can be removed. This detachable mounting may be done in any of the ways described in EP 1 840 268 (U.S. 2007/0228806) If the support ring mount 52 were not detachable, its presence might limit the depth of cut when a smaller milling drum like that of FIG. 2 is used.

FIG. 2 shows an embodiment in which the driving device 6 is coupled with the reduction gear 8 via a belt pulley 30. In FIG. 2, only the belt pulley 30 of a belt drive 28 is shown as part of the driving device 6. The combustion engine drives said belt pulley 30, for example, via a composite V-belt.

The reduction gear 8 is attached, with a housing 9, to the machine frame 2 in a permanent, torsionally rigid and rigid fashion via two spaced supports 2*a* and 2*b*. Oil for cooling the reduction gear 8 can be fed via a connection 42 of the housing 9, which exits again at a discharge port 44 and can be fed to a heat exchanger in a cooling loop. An output element 16 is arranged on the side opposite the belt pulley, said output element 16 being connected with the basic drum body 14 via a connection flange 15 and driving the same. The output element 16 is preferably connected to the basic drum body 14 coaxially and in a torsionally rigid fashion. The output element 16 forms the fixed-type bearing for the drive-side free end of the basic drum body 14. The basic drum body 14 is passed through the drive-side drum housing wall 12 via a labyrinth seal 19, which forms a barrier for dust and heat. The housing 9 is extending as can be taken from FIG. 2 in axial prolongation of the milling drum 4 within the outer walls such as 56 of the machine frame 2 and of the road milling machine 1. The driving device 6 extends to the outside beyond the outer wall 56 of machine frame 2, as seen in FIG. 2.

The other end of the basic drum body 14 is mounted in a floating-type bearing 46 in the drum housing wall 13 opposite the drive-side drum housing wall 12. The drum housing wall 13 is arranged on the zero-clearance side of the road milling machine 1, which characterizes that side on which it is possible to mill close to the edge. The easily removable drum housing wall 13 is preferably pivotable but may alternatively also be removable axially.

Attaching the basic drum body 14, on the drive side, to the output element 16 forming the fixed-type bearing ensures a high stiffness of the structure as the two elements 14,16 are connected at a point of lowest bending load because the reduction gear 8 can be attached to the machine frame 2 or the drum housing 11 respectively in a rigid fashion.

On the zero-clearance side, the spacing between the front-end edge of the milling drum 4 and the outer wall of the road milling machine 1, for example, the drum housing wall 13, is kept as small as possible.

The milling tube element 10 is fitted, for example, with milling tools 17, the leading circle or cutting radius 26 of which is indicated in FIG. 2 by the dotted line. The maximum milling depth FT is indicated relative to a further dotted line below the drum housing walls 12,13 at the lower edges 20*a*, 20*b*. The diameter ratio between the reduction gear 8 and the cutting radius 26 of the milling tools 17 of the milling tube element 10 is preferably in the range smaller than 0.45, preferably smaller than 0.4, with the diameter of the reduction gear not being able to remain below certain minimum dimensions. The diameter ratio may, for example, be between 0.35 and 0.45, preferably in the range between 0.38 and 0.42.

Between the milling tube element 10 and the drive-side drum housing wall 12, conveying blades 18 may be attachable to the basic drum body 14 in a preferably regular fashion on the circumference, said conveying blades 18 facilitating ejection of the milled material from the discharge opening 24 if the milling tube element 10 is of a smaller width than the drum housing 11.

Below the housing 9 of the reduction gear 8, preferably several wear elements, for example, scrapers 40, may be arranged parallel to the ground and, for example, orthogonally and/or parallel to the axis of rotation of the milling drum 4, said scrapers 40 resting at the machine frame 2 and protecting the housing 9 against damage. The lower edges of the scrapers 40 run at the level of the lower edge 20*b* of the drum housing wall 12.

In the event that an exchange of the milling tube element 10 is required owing to a different task in the milling operation, said exchange can be carried out quickly by first removing or pivoting the drum housing wall 13.

The threaded connections between the milling tube element 10 and the annular flange 36 of the basic drum body 14 then need to be removed, whereupon the complete milling tube element 10 can be pulled off from the zero-clearance side. Subsequently, if the milling tube element 10 is exchanged, for example, for reasons of wear, a milling tube element 10 of the same kind or a different milling tube element of equal or different milling width, for example, for fine milling, can be pushed on again. With a milling tube element 10 of greater width, an additional support ring may be mounted on the basic drum body 14 for radial support, if required.

In the event of an exchange of the milling tube element 10, both the reduction gear 8 and the basic drum body 14 may remain unchanged while the milling tube elements 10 can be mounted or removed axially from the zero-clearance side. Access from the drive side is not required.

The embodiment of FIG. 2 shows a milling tube element 10 with a short milling width that is only bolted to the basic drum body 14 via a connection flange 35 projecting from the milling tube element 10 radially and the annular flange 36 attached to the basic drum body 14.

It is of particular advantage that only the milling tube element 10 needs to be exchanged. The reduction gear 8 and the basic drum body 14 remain unchanged in relation to the driving device 6, so that an adjustment of the drive train is not required. The milling tube element 10 is centered automatically by way of its position on the basic drum body 14 and its mounting in the output element 16 of the reduction gear 8, which enables unbalances, in particular, to be avoided. The easily detachable attachment devices of the milling tube element 10 are protected against soiling and damage.

The invention claimed is:

1. An automotive road milling machine for milling ground surfaces, comprising:

a machine frame;

a drum housing attached to the machine frame, the drum housing including a drive-side drum housing wall and a removable drum housing wall opposite from the drive-side drum housing wall;

a milling drum arranged between the drive-side drum housing wall and the removable drum housing wall, the milling drum having an axis of rotation, the drive-side drum housing wall and the removable drum housing wall extending orthogonally to the axis of rotation, the milling drum including a quick change system including a basic drum body and at least one milling tube element capable of being pushed onto the basic drum body, the removable drum housing wall being removable for the exchange of alternatively usable milling tube elements;

a milling drum drive for driving the milling drum; and a planetary reduction gear between the milling drum drive and the milling drum, the planetary reduction gear including a planetary reduction gear housing torsionally rigidly attached to the machine frame between the milling drum drive and the drive-side drum housing wall.

2. The automotive road milling machine of claim 1, wherein:

the planetary reduction gear housing is torsionally rigidly attached to the machine frame outside the drum housing.

3. The automotive road milling machine of claim 1, wherein:

the planetary reduction gear includes an output element facing the drum-side housing wall; and the basic drum body includes a free end mounted on the output element so that the output element drives the basic drum body.

4. The automotive road milling machine of claim 3, wherein:

the basic drum body extends through the drive-side drum housing wall;

the free end of the basic drum body is torsionally rigidly connected to the output element; and the machine further comprises a labyrinth seal between the basic drum body and the drive-side drum housing wall.

5. The automotive road milling machine of claim 1, further comprising:

a floating bearing mounted on the removable drum housing wall; and the basic drum body including first and second ends, the first end being mounted on the planetary reduction gear, the planetary reduction gear providing a fixed bearing for the first end of the basic drum body, and the second end of the basic drum body being detachably connected to the removable drum housing wall via the floating bearing.

6. The automotive road milling machine of claim 1, further comprising:

conveying blades attached to the basic drum body between the milling tube element and the drive-side drum housing wall.

7. The automotive road milling machine of claim 1, wherein:

the drive-side drum housing wall includes a lower edge projecting downward further than the planetary reduction gear housing.

8. The automotive road milling machine of claim 1, wherein:

the at least one milling tube element is of integral design.

9. The automotive road milling machine of claim 1, wherein:

the drum housing includes a longitudinal wall extending parallel to the axis of rotation of the milling drum, and the longitudinal wall has a discharge opening defined therein.

10. The automotive road milling machine of claim 1, further comprising:

a plurality of wear elements arranged below the planetary reduction gear housing and parallel to a ground surface, the wear elements being attached to the machine frame.

11. The automotive road milling machine of claim 1, wherein:

the planetary reduction gear housing has a planetary reduction gear housing diameter;

the milling drum includes milling tools having a cutting diameter; and a ratio of the planetary reduction gear housing diameter to the cutting diameter is no greater than 0.45.

12. The automotive road milling machine of claim 11, wherein:

the ratio of the planetary reduction gear housing diameter to the cutting diameter is in a range of from about 0.38 to about 0.42.

13. The automotive road milling machine of claim 1, wherein:

the at least one milling tube element has a milling width more than one-half a maximum milling width of the drum housing; and the machine further comprises a support ring assembly attached to the basic drum body, the at least one milling tube element being received on the support ring assembly.

14. The automotive road milling machine of claim 1, wherein:

the milling drum drive includes a belt drive including a belt pulley, the belt drive projecting outward relative to the machine frame; and the planetary reduction gear housing is located outside the drum housing between the belt pulley and the drive-side drum housing wall.

15. The automotive road milling machine of claim 1, wherein:

the removable drum housing wall is located on a zero-clearance side of the machine; and the milling drum is approximately flush with the machine frame on the zero-clearance side of the machine.

16. A road milling machine, comprising:

a machine frame;

a drum housing attached to the machine frame, the drum housing including a drive-side drum housing wall and a removable drum housing wall;

a milling drum located between the drive-side drum housing wall and the removable drum housing wall, the milling drum including a drum body and a milling tube removably received on the drum body, so that the milling tube is removable by removing the removable drum housing wall and removing the milling tube from the drum body;

a planetary reduction gear including a planetary reduction gear outer housing attached to the machine frame so that the planetary reduction gear outer housing is fixed relative to the machine frame; and a milling drum drive connected to the planetary reduction gear on a side of the planetary reduction gear opposite from the milling drum.

17. The road milling machine of claim 16, wherein:

the planetary reduction gear outer housing is attached to the machine frame at at least two locations spaced along a length of the planetary reduction gear outer housing.

18. The road milling machine of claim 16, wherein:

a first end of the drum body is supported from the machine frame by the planetary reduction gear; and a second end of the drum body is supported from the machine frame by the removable drum housing wall.

19. The road milling machine of claim 18, wherein:

the drum body extends through the drive-side drum housing wall; and the machine further comprises a seal between the drum body and the drive-side drum housing wall for protecting the planetary reduction gear from debris within the drum housing.

20. The road milling machine of claim 16, wherein:

the drive-side drum housing wall extends downward from the machine frame further than the planetary reduction gear, to prevent the planetary reduction gear from engaging a ground surface.

21. The road milling machine of claim 16, wherein:

the milling tube is a one piece milling tube element.

22. The road milling machine of claim 16, wherein:

the drum housing has a discharge opening defined in a longitudinal drum housing wall extending between the drive-side drum housing wall and the removable drum housing wall.

23. The road milling machine of claim 16, further comprising:

a wear element connected to the machine frame and extending below the planetary reduction gear generally parallel to a ground surface for protecting the planetary reduction gear from engagement with the ground surface.

24. The road milling machine of claim 16, wherein:

the planetary reduction gear has a planetary reduction gear outside diameter;

the milling drum has a cutting diameter; and a ratio of the planetary reduction gear outside diameter to the cutting diameter is in a range of from 0.35 to 0.45.

25. The road milling machine of claim 24, wherein the ratio is in the range of from 0.38 to 0.42.

26. The road milling machine of claim 16, wherein:

the milling drum includes a support ring mount attached to the drum body, and the milling tube is received over the support ring mount.

27. The road milling machine of claim 16, wherein:

the removable drum housing wall is located on a zero-clearance side of the machine.

28. The road milling machine of claim 16, wherein:

the planetary reduction gear is located outside the drum housing on an opposite side of the drive-side drum housing wall from the milling drum.

* * * * *